United States Patent [19]

Putch

[11] Patent Number: 4,958,686

[45] Date of Patent: Sep. 25, 1990

[54] SUBSEA WELL COMPLETION SYSTEM AND METHOD OF OPERATION

[75] Inventor: Samuel W. Putch, Houston, Tex.

[73] Assignee: Norman A. Nelson, Houston, Tex. ; a part interest

[21] Appl. No.: 400,427

[22] Filed: Aug. 30, 1989

[51] Int. Cl.[5] ..... E21B 33/043; E21B 34/14

[52] U.S. Cl. ..... 166/348; 166/88; 166/97; 166/338; 166/344; 285/133.2

[58] Field of Search ..... 166/338, 344, 348, 349, 166/368, 382, 325, 285, 290, 339, 340, 341, 345, 351, 359, 360, 365, 367, 313, 369, 378, 380, 386, 88, 85, 97; 285/133.2, 140

[56] References Cited

U.S. PATENT DOCUMENTS

| | | | |
|---|---|---|---|
| 3,693,714 | 9/1972 | Baugh | 166/348 |
| 3,893,717 | 7/1975 | Nelson . | |
| 4,077,472 | 3/1978 | Gano | 166/315 |
| 4,125,155 | 11/1978 | Brock, Jr. | 166/97 |
| 4,623,020 | 11/1986 | Nichols | 166/88 |

OTHER PUBLICATIONS

A Maximum Safety Platform Completion System, by James M. Adams et al.; OTC Paper No. 1527, May, 1972.

An advertisement, date unknown, entitled "A Koomey Triple-S System".

*Primary Examiner*—Jerome W. Massie
*Assistant Examiner*—Ezio D. Sante
*Attorney, Agent, or Firm*—Fulbright & Jaworski

[57] ABSTRACT

A subsea well completion system having an improved tubing hanger that includes passageways through the hanger to one or more of the tubing annulus, the casing annulus and seals. The passageways may include vertically extending seal bores which are normally closed by check valves which may be operated to the open position. A tree adapter is connected to the tubing hanger and includes passageways coacting with the hanger passageways and includes externally connected side ports. The check valves may be selectively and remotely controlled externally of the completion system for monitoring the various annulus. The system may be abandoned by pumping cement through the passageways to seal them off and thereafter severing the completion system without the aid of a drilling rig.

5 Claims, 8 Drawing Sheets

SUBSEA WELL COMPLETION SYSTEM AND METHOD OF OPERATION

BACKGROUND OF THE INVENTION

Oil and gas wells which are drilled offshore are normally completed above the water surface on a fixed structure. However, in some cases it is desirable to complete these wells at the ocean floor, but this generally requires the installation of special and extensive completion equipment such as described in "A Maximum Safety Platform Completion System", OTC Paper No. 1527, May, 1972, and "A Koomey-SSS System", an advertisement, date unknown.

The present invention relates to a subsea well completion system and method in which after the well has been drilled and all casing strings set, it is only necessary to disconnect the tie-back connectors and run a novel type of tubing hanger body with tubing strings supported from it. The present system does not require the use of a high cost completion housing but instead includes a tubing hanger and tree adapter which have side outlets to permit monitoring the tubing and casing annuli pressures and/or the testing of seals. The present completion system provides a selective communication with these annuli for the detection of leaks and the possibility of bleeding off the pressures and/or pumping cement or other materials through the tree adapter and tubing hanger to seal off the leaks. Also, in the United States, the abandonment of an off-shore well requires that cement be pumped into all casing and tubing string annuli as well as down the production tubing so as to completely plug any flow path from the bottom of the well to the surface. In addition, it is required that all portions of the well be removed to at least 15 feet below the ocean floor. These requirements normally necessiate the reentry into the well using a rig similar to the one that drilled the well. These operations are obviously costly as well as hazardous.

The present invention permits the monitoring of the casing and tubing annuli, both during and after completion of the well, and further permits the pumping of cement into these annuli through external outlets on the tree adapter. This makes it possible to perform abandonment operations using a work barge and divers rather than a drilling rig. After cementing, the well completion system is severed at least 15 feet below the ocean floor such as by an explosive charge. This method of abandoning the well costs only a small fraction of that required if a rig had been used.

SUMMARY

The present invention is directed to a subsea well completion system having at least two casing strings with a casing annulus therebetween, a tubing hanger assembly sealing engaging said two casing strings and supporting at least one production tubing string and one of the production tubing forming a tubing annulus with a casing. One feature of the present invention is the improvement in a tubing hanger assembly which includes passageways extending from its top through the hanger to one or more of the tubing annulus, the casing annulus, and the sealing engagement of the tubing hanger with the two casing strings.

Another object is wherein at least one of the passageways includes a vertically extending seal bore at the top and a normally closed check valve. The check valve includes a stinger extending into the seal bore which, when actuated, opens the check valve.

Yet a still further object of the present invention is the provision of a tree adapter for connection with the tubing hanger assembly and for receiving a valve tree. The tree adapter includes a seal sub for engaging each seal bore and the adapter has a side port connected to each sub, other than the tubing sub, for externally communicating through the sub to the seal bore.

A still further object is wherein some of the subs are slideably supported from the tree adapter and sealably engage the seal bores when the adapter is connected to the tubing hanger. Means are provided extending externally of the tree adapter for moving the slidable subs relative to the stingers for opening and closing the check valves.

A still further object is the provision of a tubing hanger running tool releasably connected to the tubing hanger in which the running tool includes a seal sub for engaging each seal bore and engaging each stinger for moving the check valves to the open position while the running tool is connected to the tubing hanger.

Another object is wherein one embodiment of the means for moving the sub relative to the stinger includes first and second externally extending screws coacting with oppositely directed tapered surfaces on each seal sub for moving the seal subs in opposite directions.

In another embodiment, the means for moving the subs relative to the stingers include piston means connected to each seal sub and fluid passageways communicating with opposite sides of the piston and in which the passageways extend externally of the tubing hanger.

Another feature of the present invention is the improvement in a subsea well completion system having a drive pipe, an outer casing having a bit guide, a hanger supported from the bit guide, an inner casing extending upwardly and downwardly from the hanger, and a completion housing connected to the upwardly extending inner casing. A support is provided which includes a tubular member coaxially positioned around but spaced from the upwardly extending casing forming an annulus therebetween. One end of the tubular member is rigidly secured to the hanger and the other end is rigidly secured to the completion housing, and cement fills the annulus. Preferably, the cement is inserted into the annulus when the inner upwardly extending casing is placed in tension.

A still further object of the present invention is the provision of a method of monitoring the casing annulus between at least two casing strings and the tubing annulus between a production tubing string and a casing in a subsea well completion system. The method includes installing a tubing hanger having passageways extending from its top to each of the casing annulus and tubing annulus, installing a tree adapter to the tubing hanger having passageways extending externally of the adapter to each of the tubing hanger passageways. The method includes selectively opening and closing said passageways from externally to the tree adapter and monitoring said casing and tubing annuli.

The present invention is also directed to the feature of abandoning a subsea completion including selectively opening the passageways, pumping cement through the opened passageways into the tubing annulus and the casing annulus from externally of the tree adapter to plug off the tubing annulus and the casing annulus, and thereafter severing the subsea completion.

A further object is directed to the method of abandoning a subsea well completion having at least one tubing annulus and at least one casing annulus without the use of a rig which includes providing an openable passageway in the subsea completion extending between the tubing annulus and a point externally of the well completion and an openable passageway extending between the casing annulus and a point external of the well completion. The method is directed to opening said passageways and pumping cement into both of the tubing annulus and the casing annulus from externally of the well completion for plugging the annuli, and thereafter severing the subsea completion, such as by using an explosive charge.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

Figure 1:
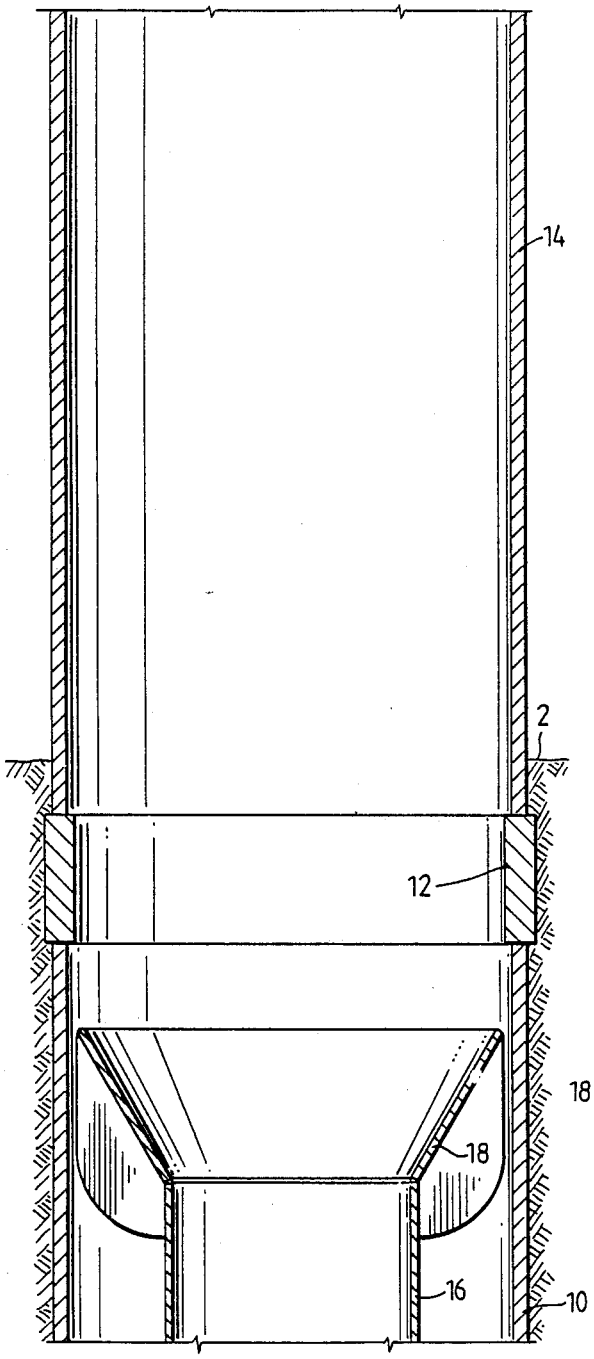
FIGS. 1, 2, 3, and 4 are elevations, in cross section, of the beginning sequences of installing the subsea well completion system of the present invention.

Referring to the drawings, and particularly to FIG. 1, a conductor or drive pipe, such as 30 inch, is driven into the ocean floor 2 using a pile driver (not shown) operating from the water surface. The conductor pipe 10 includes a releasable connector 12 such as manufactured by Dril-Quip, Inc., that is positioned so that it will be at least 15 feet below the ocean floor 2 and can be disconnected to permit removal of that portion of the conductor pipe 10 above the connection 12 known as a riser pipe 14. An outer casing 16, such as 16 inch casing, is positioned inside of the conductor pipe 10 with a bit guide 18, such as one manufactured by Davis-Lynch Company, so that its top is below the releasable connector 12. The outer casing 16 is then cemented in place.

Figure 2:
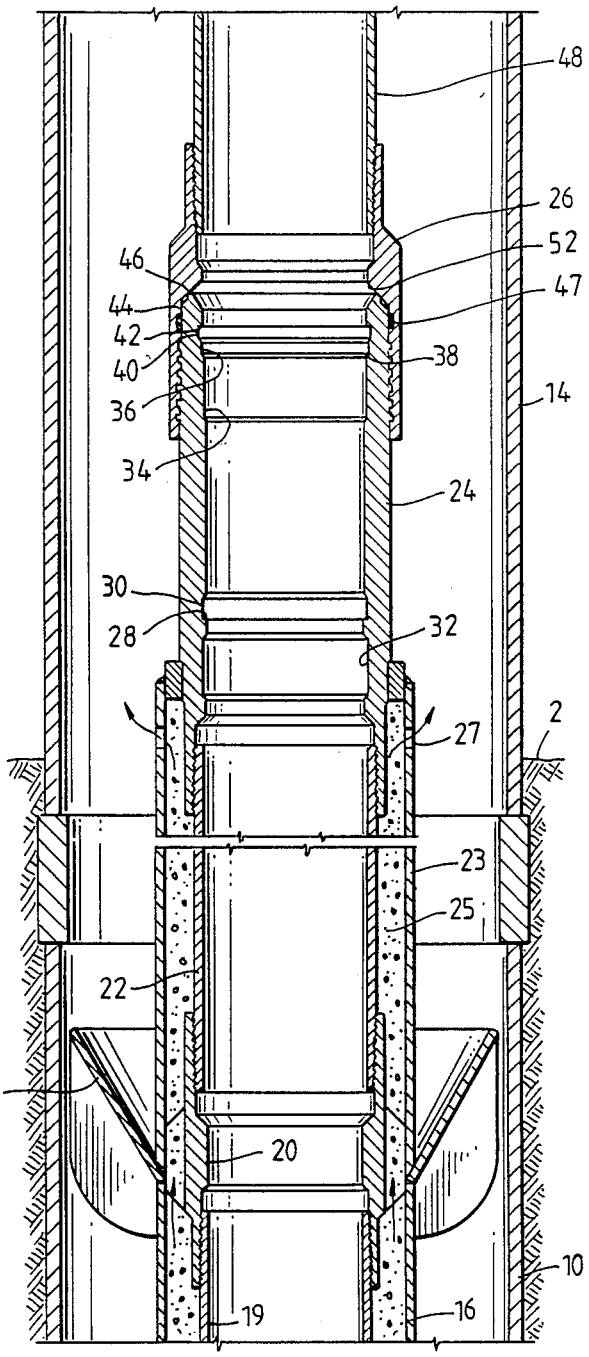

Referring now to FIG. 2, a fluted hanger 20 is landed in and supported from the bit guide 18. The fluted hanger 20 has an inner casing or protective casing 19, such as 10-¾" casing, extending downwardly and a section of surface casing 22 extending upwardly from the fluted hanger 20 to a point above the ocean floor 2 where it is connected to a completion housing 24. In addition, a second joint or tubular member of larger diameter casing 23 is rigidly attached to both the fluted hanger 20 and the completion hanger 24, such as by welding, and is coaxially positioned around but spaced from the upwardly extending inner casing or surface casing 22. The tubular member 23 thereby creates a secondary support member between the fluted hanger 20 and the completion housing 24 providing additional strength to resist any bending forces acting upon the completion housing 24. Cement 25 is inserted within the annulus between the inner casing 22 and the tubular member 23 downwardly through the casing 19 and up the annulus and out openings 27 to increase the strength of this section. Preferably, during the placement of the cement 25 the completion housing 24 is held in tension thereby providing a prestressed joist of greater strength.

The completion housing 24 is releasably connected to protective casing riser connector 26 and includes an upwardly facing load bearing shoulder 28 located in a circumferential groove 30 with a second groove 32 located below groove 30 to serve as a keying groove, such as described in U.S. Pat. No. 3,893,717. A third multiple enlarged inside diameter section is located at the top of the completion housing 24. The first enlarged bore section is a seal bore 34. The next upper enlarged bore 36 includes an inwardly and upwardly facing load bearing shoulder 38. A third inner diameter groove 40 is located above the shoulder 38 and includes an inwardly and downwardly facing load bearing shoulder 42. The upper external portion of completion housing 24 includes male threads that engage with female threads of riser connector 26 and an external seal surface 44 and an upwardly facing circumferential seal lip 46. Riser connector 26 is connected to a protective casing riser 48 and includes female threads at its lower end that mate with the male threads on completion housing 24. An elastomeric type seal 47 is located on the inner circumference of riser connection 26 just above the threads and a downwardly and inwardly facing surface 52 engages seal lip 46, thereby creating metal-to-metal seal between the completion housing 24 and riser connector 26.

Figure 3:
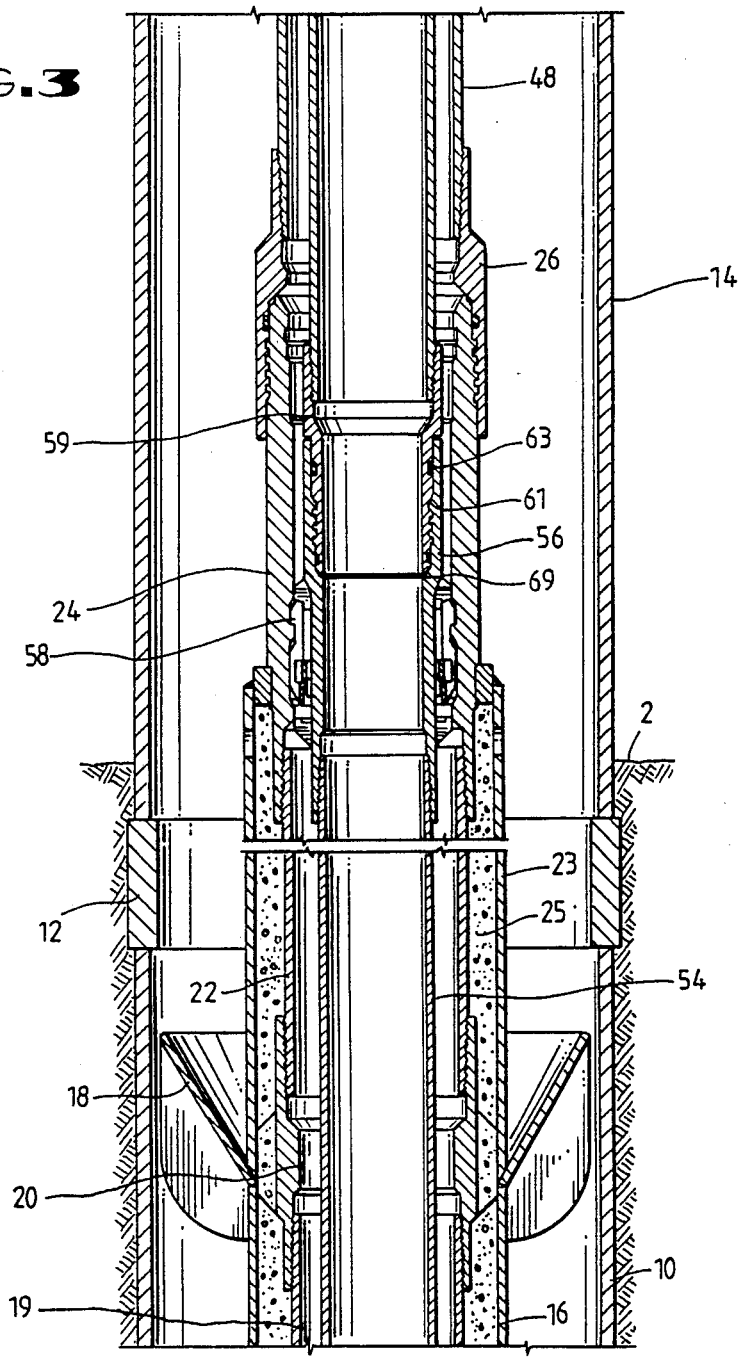

Referring now to FIG. 3, a production string casing 54, such as a seven inch casing, is positioned in place and is suspended from casing hanger 56 which may include an expanding hanger 58 that mates with grooves 30 and 32 on the inner circumference of production housing 24 similar to that described in U.S. Pat. No. 3,893,717. Casing hanger 56 is releasably connected to a riser connector 59 by means of coacting threads 61 and includes seal means 63 which seals in seal bore 65 as well as a downwardly facing seal lip 69 to create a pressure tight seal between casing hanger 56 and riser connector 59.

Figure 4:
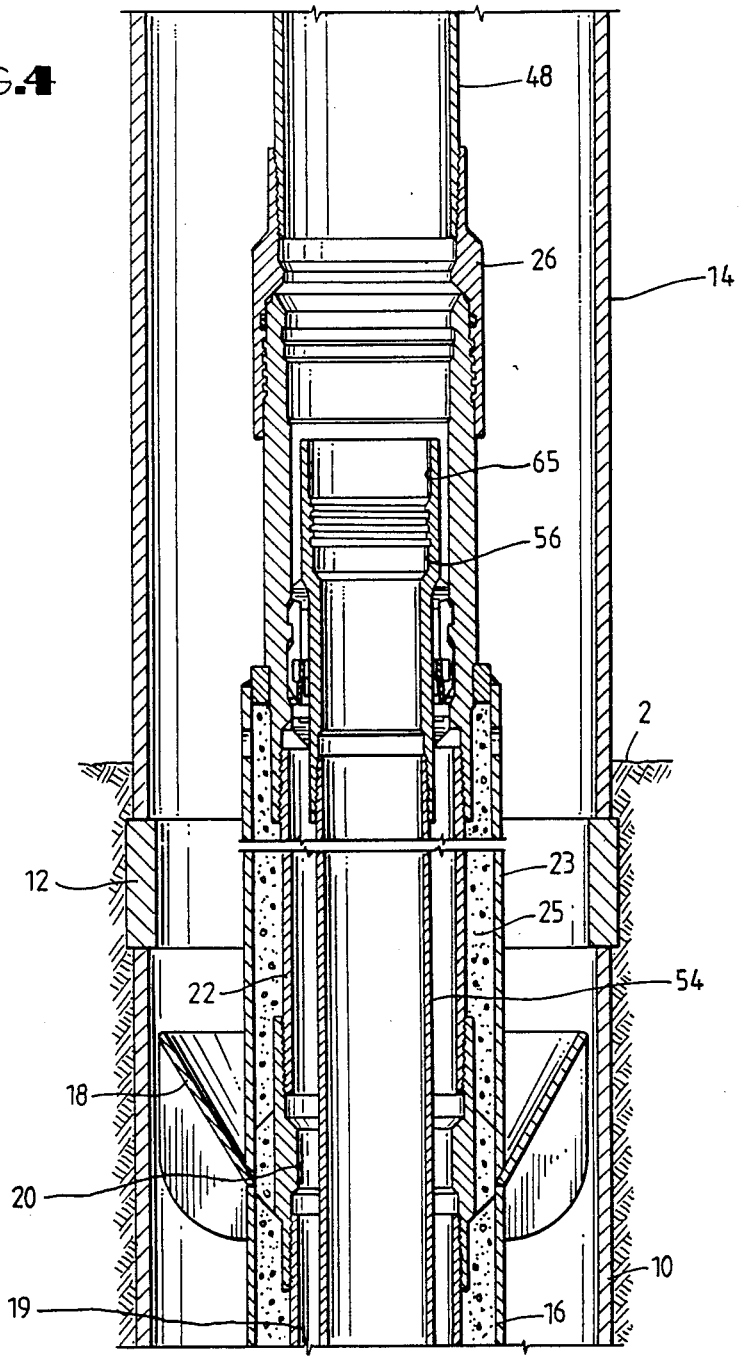

FIG. 4 is the same as shown in FIG. 3, except that the riser connector 59 has been disconnected from casing hanger 56 and removed from the well.

Figure 5:
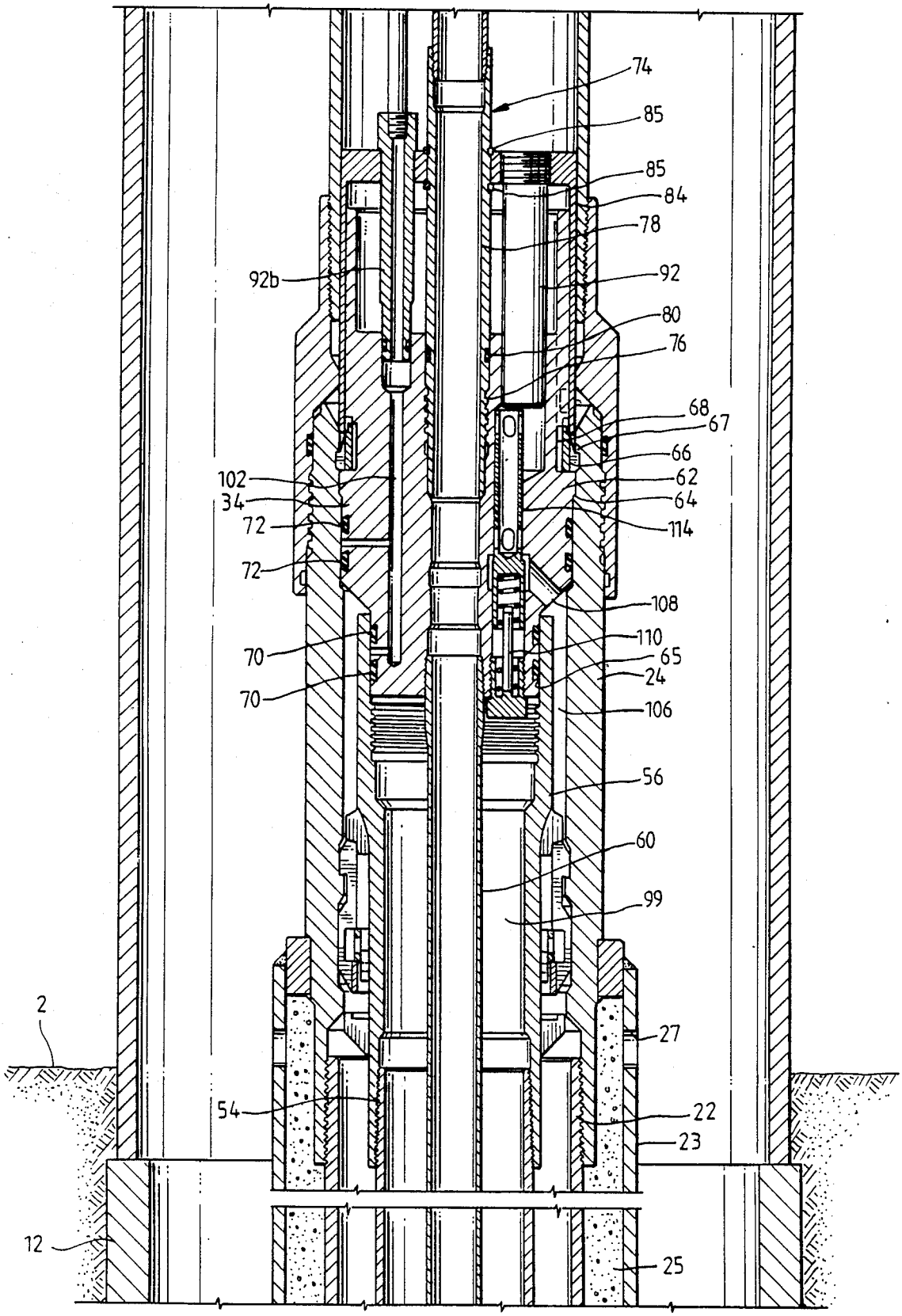
FIG. 5 is an enlarged, elevational view, in cross section, illustrating the installation of the tubing hanger of the present invention by a running in tool.

Referring now to FIG. 5, production tubing 60 is installed in the well and threadably connected to and suspended from a tubing hanger 62 which in turn is supported in the completion housing 24 by virtue of outwardly and downwardly facing circumferential shoulder 64 resting on inwardly and upwardly facing load bearing shoulder 38 (FIG. 8) of completion housing 24, and is releasably locked in place in completion housing 24 by virtue of an outwardly biased lock ring 66, which is retained in external groove 68 on tubing hanger 62, expanding into groove 40 of completion housing 24. The tubing hanger 62 includes two sets of external circumferential seals, the lower seal set 70 engage seal bore 65 in casing hanger 56 while the upper seal set 72 engage seal bore 34 of production housing 24. The tubing 60 and tubing hanger 62 are lowered into the well into this position by virtue of being threadably connected to running/retrieving tool 74 by coacting threads 76. The running/retrieving tool 74 consists of two major parts: (1) the tubing connection member 78 which is releasably connected to tubing hanger 62 by threads and includes an external seal 80, and (2) the skirt member 84 that is connected to tubing connection member 78 by snap rings 85. Tubing connection member 78 can be rotated without rotating skirt member 84. Tubing hanger 62 has a plurality of passageways extending from its top, two of which are shown in FIG. 5, one of which is passageway 102 which communicates between the seals 70 and also between the seals 72. The other passage 108 leads to the annulus 106 between the inside of the completion housing 24 and casing 22 and the outside of casing hanger 56 and casing 54 and includes a spring-loaded check valve 110 that is connected to a stinger 114. The check valve 110 is normally closed but may be forced to the open position allowing free flow in the passageway 108 in either direction when the stinger 114 is depressed. The running/retrieving tool 74 includes seal subs **92*b* and 92 with 92*b* being in communication with passageway 102 and sub 92 contacting and actuating the stinger 114 to be in communication with and open the check valve 110 to permit fluid flow in either direction through the passageway 108 which is advantageous during the running operation because it prevents a pressure lock from occurring when landing the hanger. In the event it should be necessary, the running tool 74 can be rotationally retracted to permit check valve 110 to close and shut off any flow from the annulus 106, while still remaining connected to the tubing hanger 62**.

Rotating tubing connection member 78 will disengage the running/retrieving tool 74 from tubing hanger 62. If it is desired to retrieve the tubing hanger 62, the running/retrieving tool 74 is run and tubing connection member 78 is screwed into threads 76 of tubing hanger 62 until the skirt member 84 has engaged the tapered surfaces 67 of spring 66 and compressed spring 66 into groove 68 of tubing hanger 62, permitting tubing hanger 62 to be pulled up.

Figure 6:
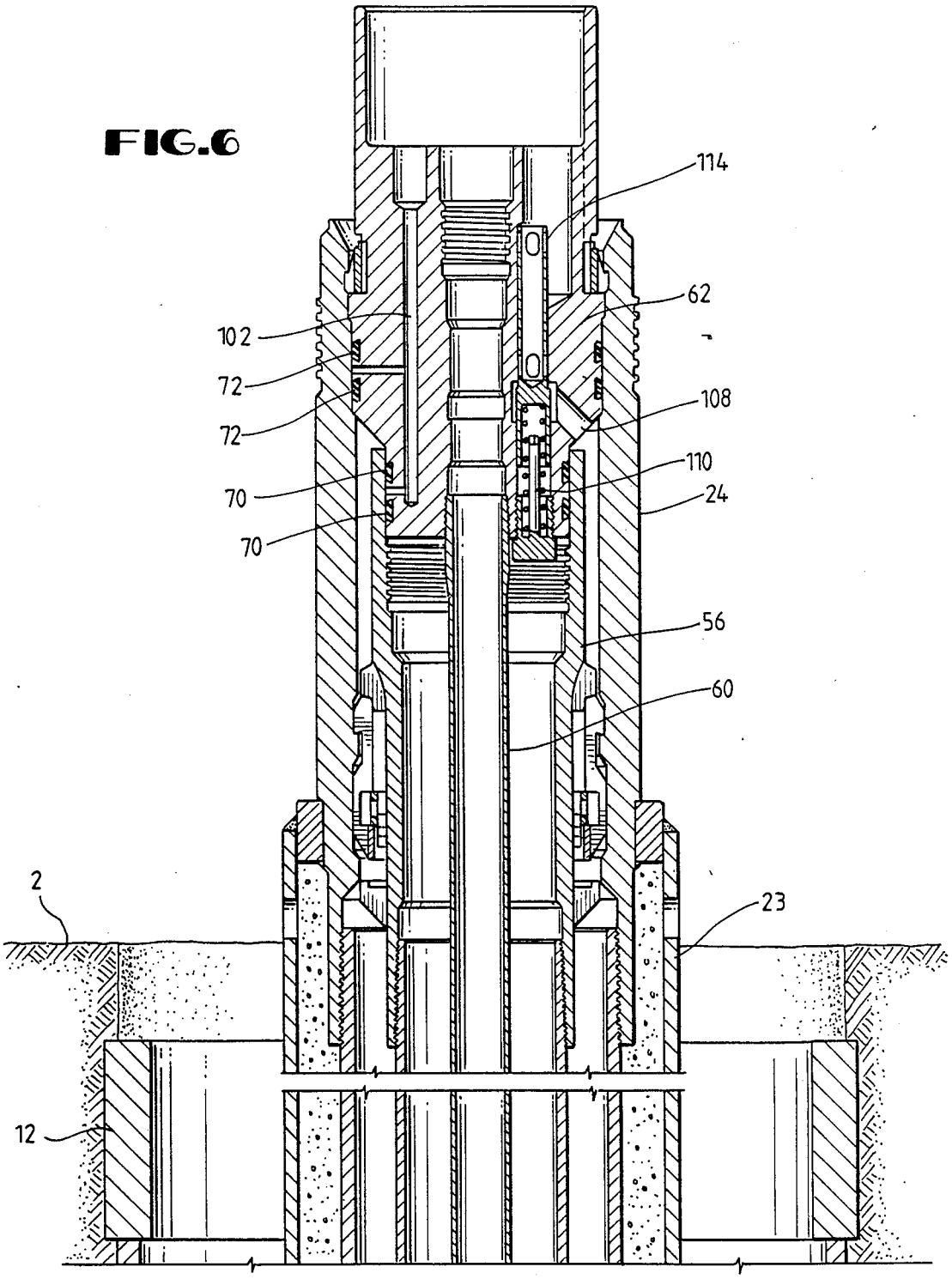
FIG. 6 is an elevational view, in cross section, of the next sequence of operation with the outer drive pipe and running tool removed.

In the next sequence of the subsea well completion, as best seen in FIG. 6, the tubing hanger 62 is locked in place in completion housing 24 and the running/retrieving tool 74 has been removed. Also, the conductor riser 14 has been removed by disconnecting it from the releasable connector 12.

Figure 7:
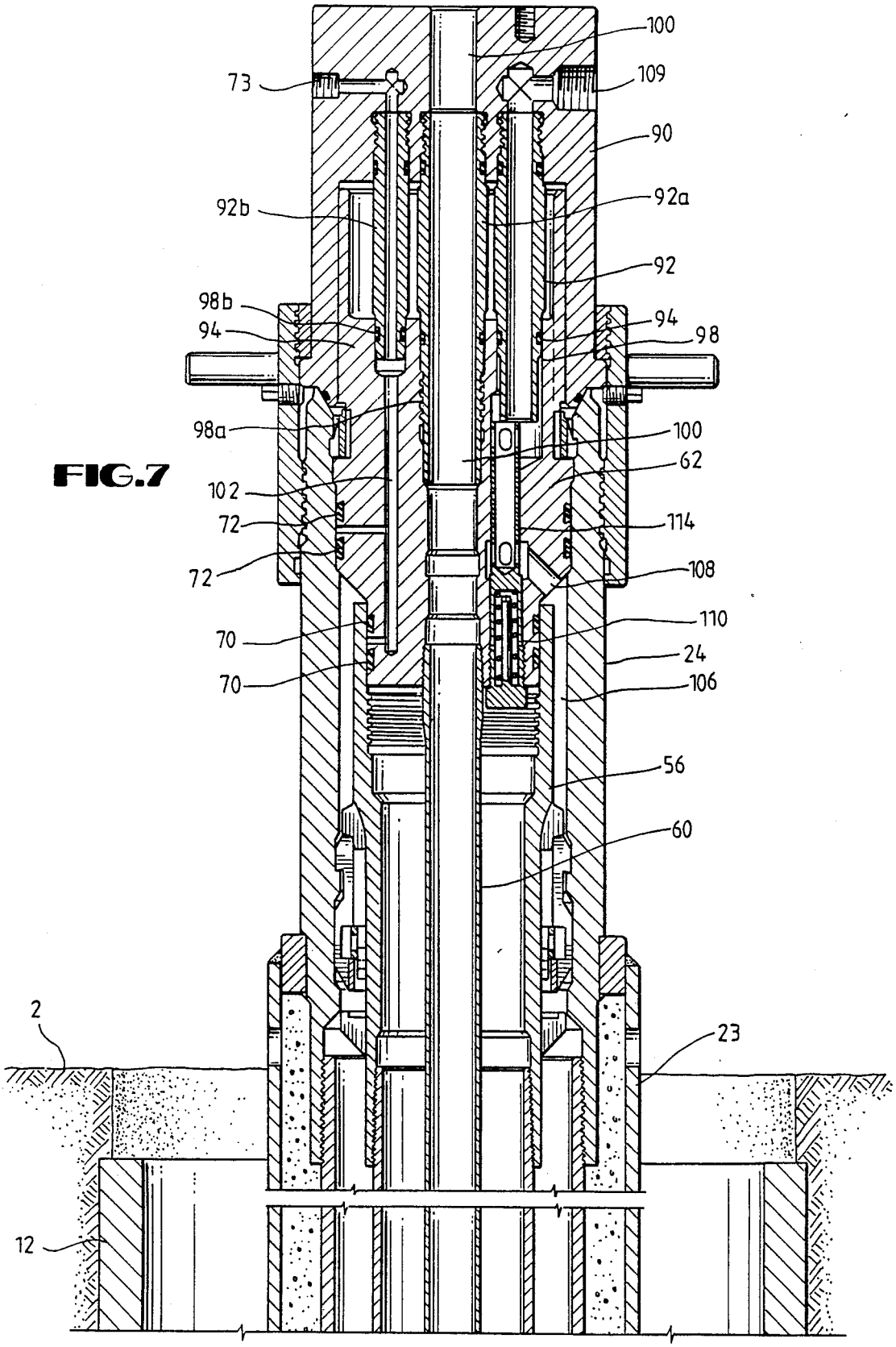
FIG. 7 is an elevational view, in cross section, of the next sequence in which a tree adapter is positioned on the tubing hanger.
Figure 7A:
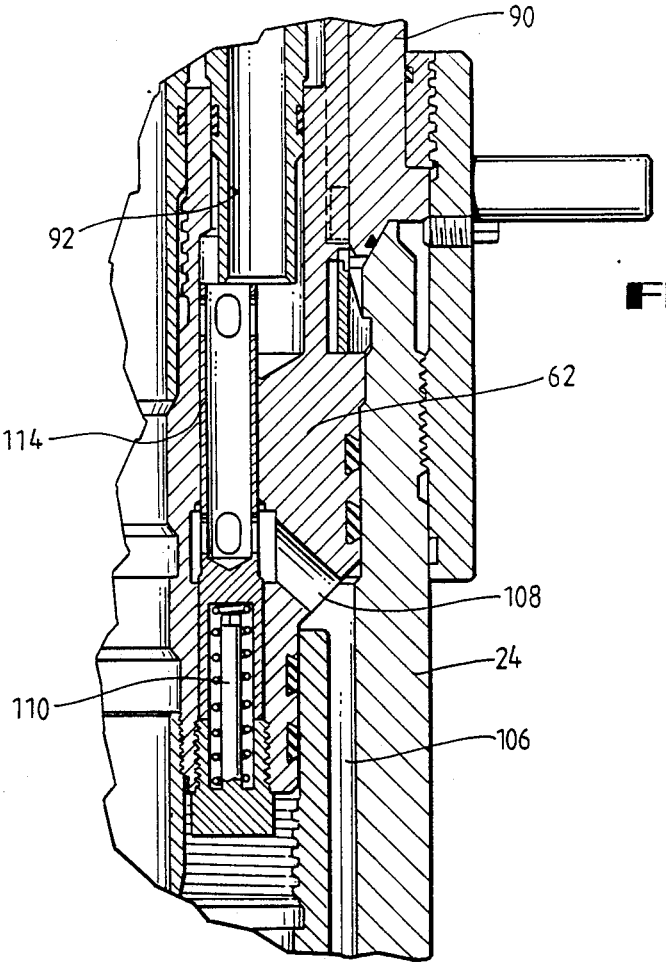
FIG. 7A is a fragmentary, elevational view illustrating one of the check valves of FIG. 7 in the tubing hanger.

Referring now to FIGS. 7 and 7A, a tree adapter 90 is being connected to the wellhead housing 24. The tree adapter 90 includes seal subs that permit pressure tight connection between various vertical passageways in the tubing hanger 62 including the tubing runs and various monitoring and access passageways 102 and 108. Thus, seal subs 92, **92*a* and 92*b* are provided in which subs 92*a* and 92*b* may be threadably connected to tree adapter 90 and have external elastomer seals 94 on the lower ends which mate with female seal bores 98 in tubing hanger 62. Normally, the tubing bore 100 extends through adapter 90 to provide full opening vertical access into the tubing string 60. The other passageways normally terminate as threaded side outlets on the tree adapter 90. Thus, Passageway 102 terminates in threaded side outlet 73 and passageway 108 terminates in threaded side outlet 109. As previously indicated, passageway 102 permits monitoring and testing of the seals 70 and 72 on tubing hanger 62. Passageway 108 includes, as previously indicated, spring loaded check valve 110 that is normally closed but may be forced open by pushing valve stinger 114 downwardly. Therefore, seal sub 92 is slideably supported in the tree adapter 90 for vertical movement, as will be more fully described hereinafter, for engaging and actuating the valve stinger 114 for forcing the check valve 110 to open and permit free flow through the passageway 108 in either direction. Other passageways, not shown, are provided in the tree adapter 90 and the hanger 62, similar to passageways 102 and 108**, for providing external communication to each tubing and casing annulus as well as means for hydraulically operating downhole safety valves.

Figure 8A:
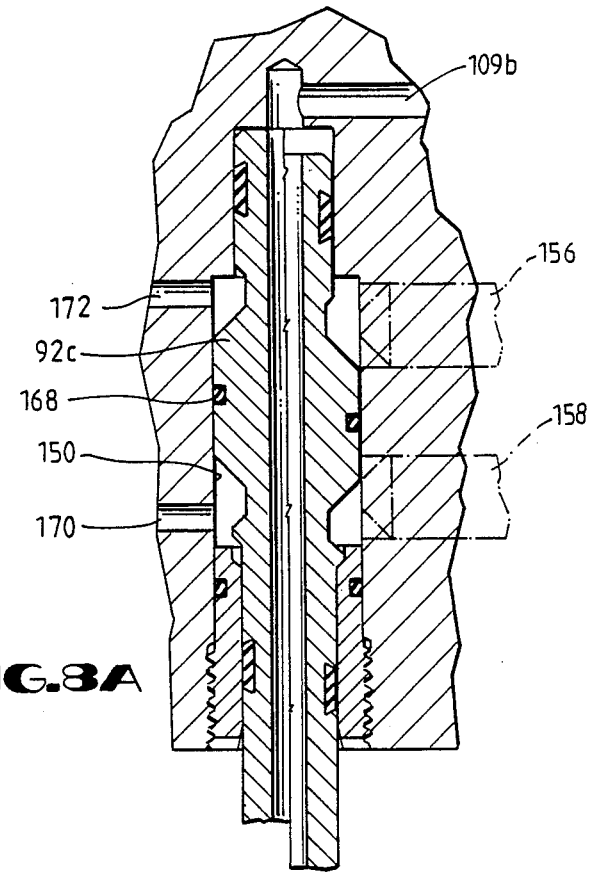
FIG. 8A is a fragmentary, enlarged elevational view, in cross section, illustrating various modes of actuating the check valve of FIG. 8.
Figure 8:
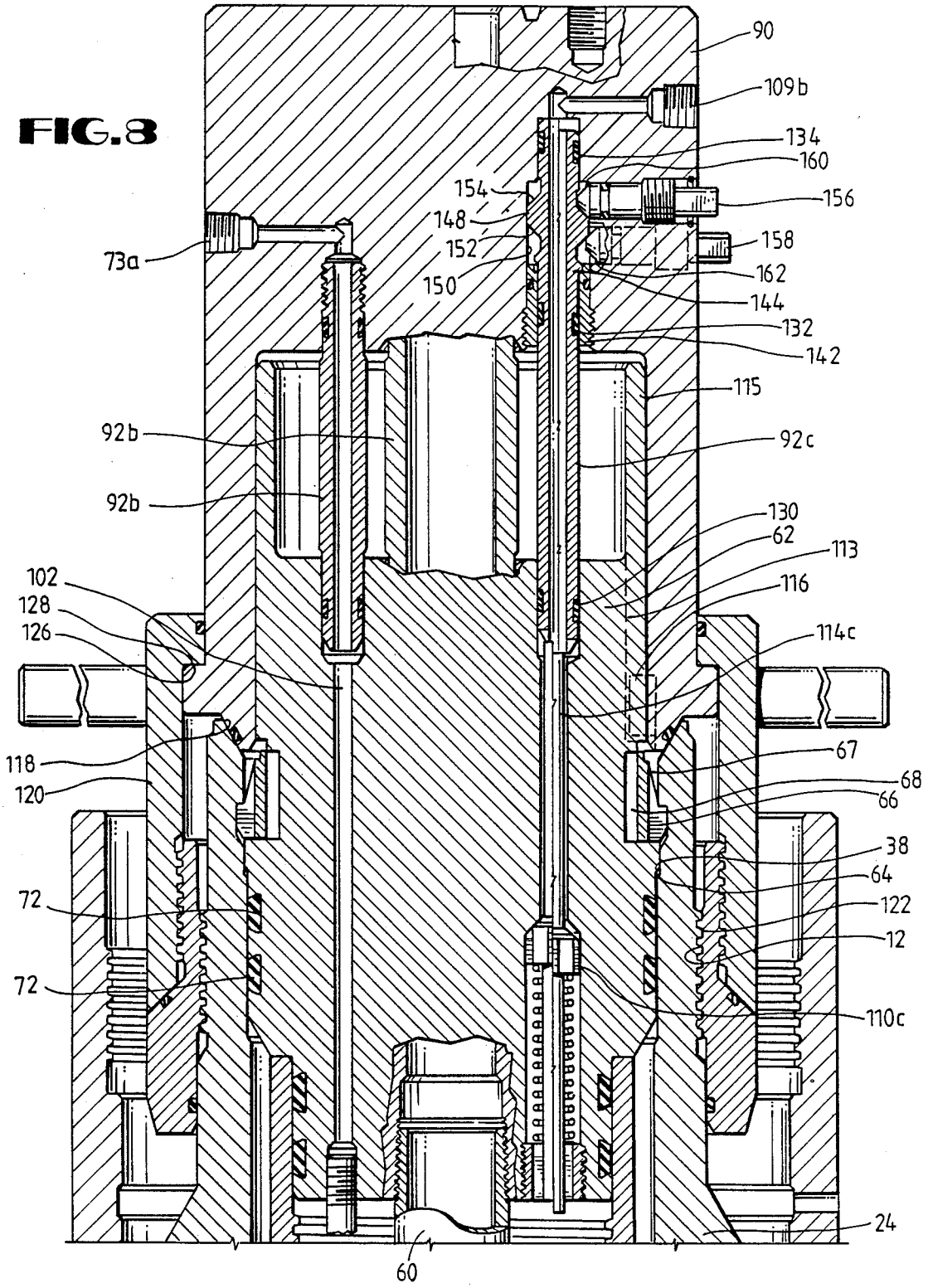
FIG. 8 is an enlarged, elevational view, in cross section, of the tubing hanger and tree adapter of FIG. 7 in a different cross section.

FIG. 8 shows the details of connecting the adapter 90 to completion housing 24, but showing a passageway to a different annulus, that is, annulus 99 (FIG. 5) between production tubing 60 and production string casing 54 as well as the method of selectively operating and closing a check valve **110*c*, after the adapter 90 has been connected to the housing 24. Since the vertical passageway seal bores may be of different sizes and located at various spaces through the tubing hanger 62, it is necessary that the seal subs 92, 92*a*, 92*b*, 92*c* and others, if any, be oriented to exactly mate with the various seal bores. To accomplish this, a vertical keyway slot 113 is formed with a funnel portion 115 at its top on the outer circumference of tubing hanger 62. A mating key 116 is positioned on the bottom inside circumference of adapter 90 so that when the key 116 is in the slot 113, the various seal subs will mate with their respective seal bores in the inner top of the tubing hanger 62**.

As the tree adapter 90 is lowered into full contact with the completion housing 24 at surface 118, the internal threads 124 of a union type nut 120 engage the external threads 122 on housing 24. Rotation of the nut 120, by a diver, engages the threads 122 and 124 thus permitting nut 120 to move down until its inwardly and downwardly circumferential shoulder 126 contacts outwardly and upwardly facing circumferential shoulder 128 on adapter 90. Further tightening of the nut by the diver forces the adapter 90 to make tight contact with head 24 to surface 118 thus providing a rigid connection.

Referring still to FIGS. 8 and 8A, several embodiments are provided for selectively opening and closing the spring-loaded check valve such as valve **110*c*. Seal sub 92*c* includes seals 130, 132 and 134 installed in external circumferential grooves that mate with the seal bores. Seal sub 92*c* is retained in the tree adapter 90 by threaded bushing 142 which has a bore smaller than the shoulder 144 on seal sub 92*c***.

An enlarged portion 148 of seal sub **92*c* is positioned in the bore 150 and includes two externally oppositely directed conical surfaces such as 152 which faces downwardly and 154 which faces upwardly. Two threaded actuator screws 156 and 158 extend externally of the adapter 90 and include conical ends 160 and 162, respectively, which will mate with the conical surfaces 154 and 152, respectively. The screws 156 and 158 are threaded into the adapter 90 from its outer side surface and include seals. When the lower screw 158 is screwed in, its conical surface 162 contacts conical surface 152 forcing the seal sub 92*c* up, preventing it from making contact with the check valve stinger 114*c* and thereby permitting check valve to be spring closed. When it is desired to open check valve 110*c*, actuator screw 158 is retracted and actuator screw 156 is screwed in until its conical end 160 contacts conical surface 154 on sub 92c. This forces seal sub 92c downwardly until it makes contact with check valve stinger 114c and in turn forcing it down until check valve 110c** is forced open.

As an alternate or additional method of operating sub 92c, and as best seen in FIG. 8A, a seal 168 is installed on the outer circumference of the enlarged portion 148 of seal sub 92c to provide sealing engagement with the counter bore 150. By applying fluid pressure through port 170, the seal sub 92c is forced upwardly to prevent it from contacting check valve stinger 114c. Applying fluid pressure through port 172 the seal sub is forced downwardly into engagement with the check valve stinger 114c forcing check valve 110c to open. The rotation of the actuator screws 156 and 158 as well as the application of fluid pressures would normally be done by a diver. Other seal subs which actuate check valves, such as seal sub 92c, may be similarly operated.

Although it is not shown, a conventional valve assembly, known as a "Christmas Tree" is installed on top of the tree adapter 90, permitting well flow to be controlled in the same fashion as a conventional subsea well.

The tree adapter 90 and tubing hanger 62 provide access to all annuli and seal points in the well to permit monitoring and if necessary provide passageways for subsequent injection of sealing compounds to correct leaking seals or cement to seal off various annuli and well bores. These operations can be performed by divers through side outlets such as 73, 109 and 109b located above the ocean floor 2.

Another feature of the present invention is that it allows the abandonment of offshore wells which are required to have cement pumped into all casing and tubing string annuli as well as down the tubing strings so as to completely plug any path flow from the bottom of the well to the surface and in addition requires that all portions of the well be removed to at least 15 feet below the ocean floor. Normally, these requirements require reentry into the well using a rig similar to the one that drilled the well. By the use of the present invention, the various annuli can be plugged with cement through the side openings such as ports 109 and 109b and other similar ports to other well annuli using a work barge and divers rather than a drilling rig. The final removal of all equipment down to at least 15 feet below the ocean floor 2 may be accomplished by any suitable severing operation from this same vessel such as simply lowering an explosive charge in the well through the tubing with a wireline to a predetermined point at least 15 feet below the ocean floor 2. Subsequent detonation of the charge severs the oil well pipe and permits removal of all equipment down to the point of severence. This method of abandoning the well costs only a small fraction of that required if a rig had been used.

The present invention, therefore, is well adapted to carry out the objects and attain the ends and advantages mentioned as well as others inherent therein. While presently preferred embodiments of the invention have been given for the purpose of disclosure, numerous changes in the details of construction, arrangement of parts, and steps of the process, may be made which will readily suggest themselves to those skilled in the art and which are encompassed within the spirit of the invention and the scope of the appended claims.

What is claimed is:

1. In a subsea well completion system having at least two casing strings with a casing annulus therebetween, a tubing hanger assembly sealingly engaging said two casing strings and supporting at least one production tubing string, one of the production tubing string forming a tubing annulus with a casing, said tubing hanger including passageways extending from its top through the hanger to one or more of the tubing annulus, the casing annulus, and the sealing engagement of the tubing hanger with the two casing strings, at least one of the passageways includes a vertically extending seal bore at the top and a normally closed check valve for normally preventing upward vertical flow therethrough, said check valve having a stinger extending into the seal bore which, when actuated, opens the check valve, a tree adapter for connection to the tubing hanger assembly and for receiving a valve tree, said tree adapter including a seal sub for engaging said seal bore, said adapter having a side port connected to said sub for externally communicating through the sub to said seal bore the improvement comprising, wherein said sub is slidably supported from the tree adapter and sealably engages the seal bore when the adapter is connected to the tubing hanger and means extending externally of the tree adapter for moving the sub relative to the stinger for opening and closing the check valve.

2. The apparatus of claim 1 wherein the means for moving the sub relative to the stinger include first and second externally extending screws coacting with oppositely directed tapered surfaces on each seal sub for moving the seal sub in opposite directions.

3. The apparatus of claim 1 wherein the means for moving the sub relative to the stinger includes piston means connected to each seal sub and fluid passageways communicating with opposite sides of the piston, said passageways extending externally of the tubing hanger.

4. The apparatus of claim 1 including, a tubing hanger running tool for a releasable connection to the tubing hanger, said running tool including a seal sub for engaging said seal bore and engagable with said stinger for moving the check valve to the open position while the running tool is connected to the tubing hanger, and means for extending and retracting the seal sub for engaging and disengaging from the stinger while the seal sub remains engaged with the seal bore and the running tool remains connected to the tubing hanger.

5. The apparatus of claim 4 wherein the means for extending and retracting the seal sub includes a threaded connection between the tubing hanger running tool and the tubing hanger.

* * * * *